United States Patent [19]

Daswick

[11] 4,241,523

[45] Dec. 30, 1980

[54] SHOE SOLE STRUCTURE

[76] Inventor: Alexander C. Daswick, South Pasadena, Calif.

[21] Appl. No.: 945,443

[22] Filed: Sep. 25, 1978

[51] Int. Cl.[3] ..... A43B 13/12; A43B 5/00

[52] U.S. Cl. ..... 36/30 R; 36/32 R

[58] Field of Search ..... 36/30 R, 25 R, 129, 36/28, 32 R

[56] References Cited

U.S. PATENT DOCUMENTS

| | | | |
|---|---|---|---|
| 2,435,976 | 2/1948 | Monagin | 36/30 R |
| 2,611,978 | 9/1952 | Joyce, Jr. | 36/30 R |
| 3,835,556 | 9/1974 | Panaretos | 36/28 |
| 4,030,213 | 6/1977 | Daswick | 36/30 R |
| 4,041,619 | 8/1977 | Sapper | 36/25 R |

*Primary Examiner*—James Kee Chi

*Attorney, Agent, or Firm*—Gene W. Arant

[57] ABSTRACT

A shoe having improved fastening means for holding it upon a wearer's foot includes a tongue having fingers extending laterally from each of its sides. Slits are formed in each side wall of the shoe near to the shoe sole. The fingers extending from each side of the tongue pass through the slits in the associated side wall and then in a reverse direction to extend over the upper surface of the shoe, where the two sets of fingers are fastened together.

A shoe having improved means for supporting and protecting the foot of the wearer includes a relatively flat rigid supporting base for the foot. A relatively rigid rocker member which is longitudinally curved to form a load-bearing pedestal is placed beneath the base. One end of the rocker member is pivotally secured to the base and the other end is spaced from it. The space between the rocker member and the base is filled with resilient material.

A running shoe has an elongated flat rigid base for supporting the wearer's foot, which extends the full length of the foot and is also turned upwardly at its rearward end to partially enclose the heel. The rigid base is hinged at the location of the metatarsal arch so that the forward portion of the base may bend upwardly relative to the rearward portion.

1 Claim, 7 Drawing Figures

35
34
33
25
H
Rt
C
B
S
-10-
30
-R-
P2
I
T
19e
23e
13e
L
M
23d
13d
19d
Rm
23c
13c
19c
2
P1
23b
13b
19b
23a
13a
19a
SS
32
15
31
C
19c
13c
12
23c
B
I
L
T
21c
10
SS
17c
11c

Fig. 3.
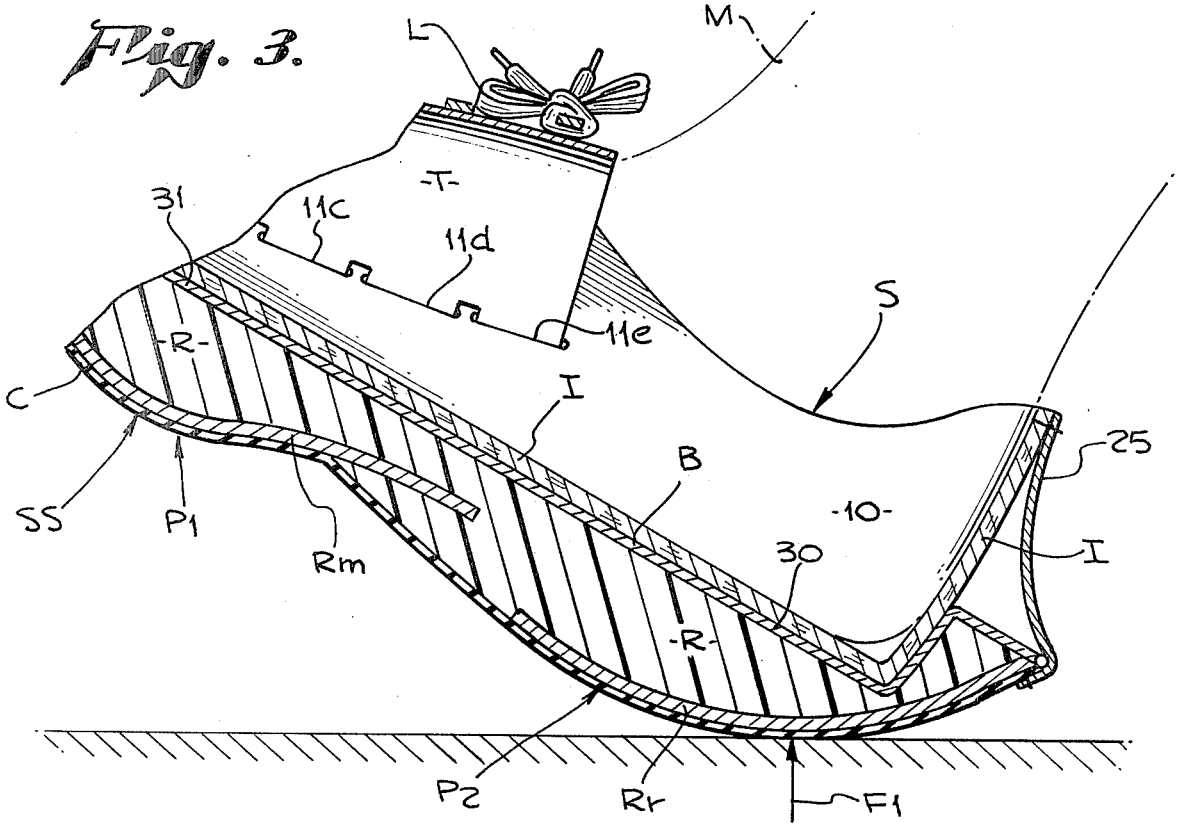
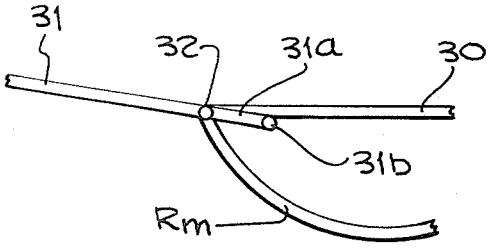
Fig. 7.
Fig. 4.
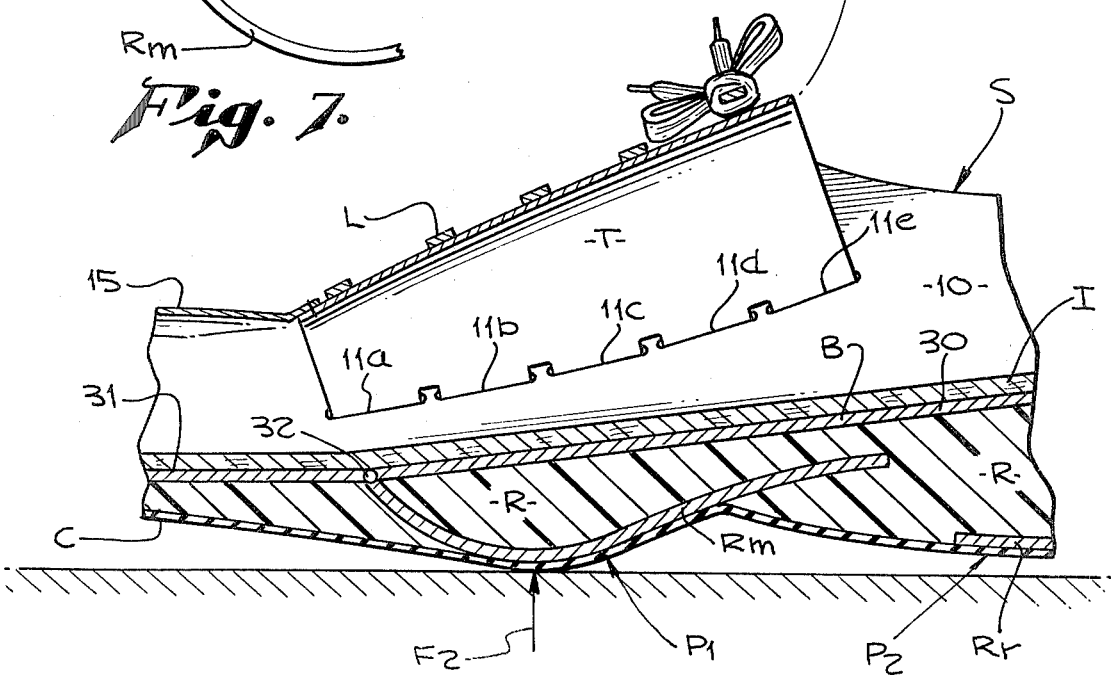

T
13b
13a
L
10
15
30
32
P1
F3
F4
SS
C
I
S
M
-10-
-12-
-R-
R'
P2
B'
21e
17e
11e
21d
17d
11d
21c
17c
11c
21b
17b
11b
21a
17a
11a
Rm

SHOE SOLE STRUCTURE

BACKGROUND OF THE INVENTION

The mechanical structure of shoes has been improved significantly in recent years. In athletic shoes particularly, structural improvements have been devised in order to improve the efficiency, comfort, and/or useful life of the shoe.

One novel design for an athletic shoe is shown in my U.S. Pat. No. 4,030,213 issued June 21, 1977. That patent discloses the concept of a pedestal or rocker which is located near the longitudinal center of the shoe, so as to permit a rolling movement of the foot during running.

The pattern of movement of the foot is different for running, for jogging, and for walking. The movement pattern of the foot also depends upon individual characteristics of the person involved, such as his age, weight, and the extent of professional training, if any, that he has had in running. Also, the movement pattern of the foot is determined in part by characteristics of the shoe, and whether it appropriately fills the need to match the natural movements of the runner to the terrain or other supporting surface on which he is running.

In view of the foregoing considerations it is evident that the optimum mechanical design of a shoe used for running will not necessarily be optimum for purpose of jogging, and vice versa. Also, the optimum design of a walking shoe will differ from that of a running or jogging shoe.

SUMMARY OF THE INVENTION

The present invention, while relating entirely to shoes, nevertheless provides several separate and distinct inventions which may be utilized independently of each other.

According to one of the inventions an improved fastening means is provided, which confines the foot of the wearer between the tongue and base of the shoe in a very direct manner, rather than indirectly as has been the practice heretofore.

According to another separate and distinct invention the sole structure of a shoe includes a relatively flat rigid base member for supporting the foot of the wearer, and a curved rocker member that is positioned beneath the base, with one end only of the rocker member being pivotally secured to the base while the space between them is filled with a resilient material.

According to another and distinct invention a shoe is provided with a flat rigid base extending the full length of the foot, but which is hinged at the location of the metatarsal arch so that the forward portion of the base may bend upwardly relative to the rearward portion.

DRAWING SUMMARY

FIG. 3 is a fragmentary view of the heel portion of the shoe of FIG. 1 shown engaging the ground in a running position;

FIG. 4 is a fragmentary cross-sectional view of the shoe of FIG. 1 showing a running position in which the main pedestal of the shoe carries the load;

FIG. 7 is a fragmentary view showing a detail of the base structure of the shoe.

FIRST EMBODIMENT

(FIGS. 1–5)

Figures 1, 2:
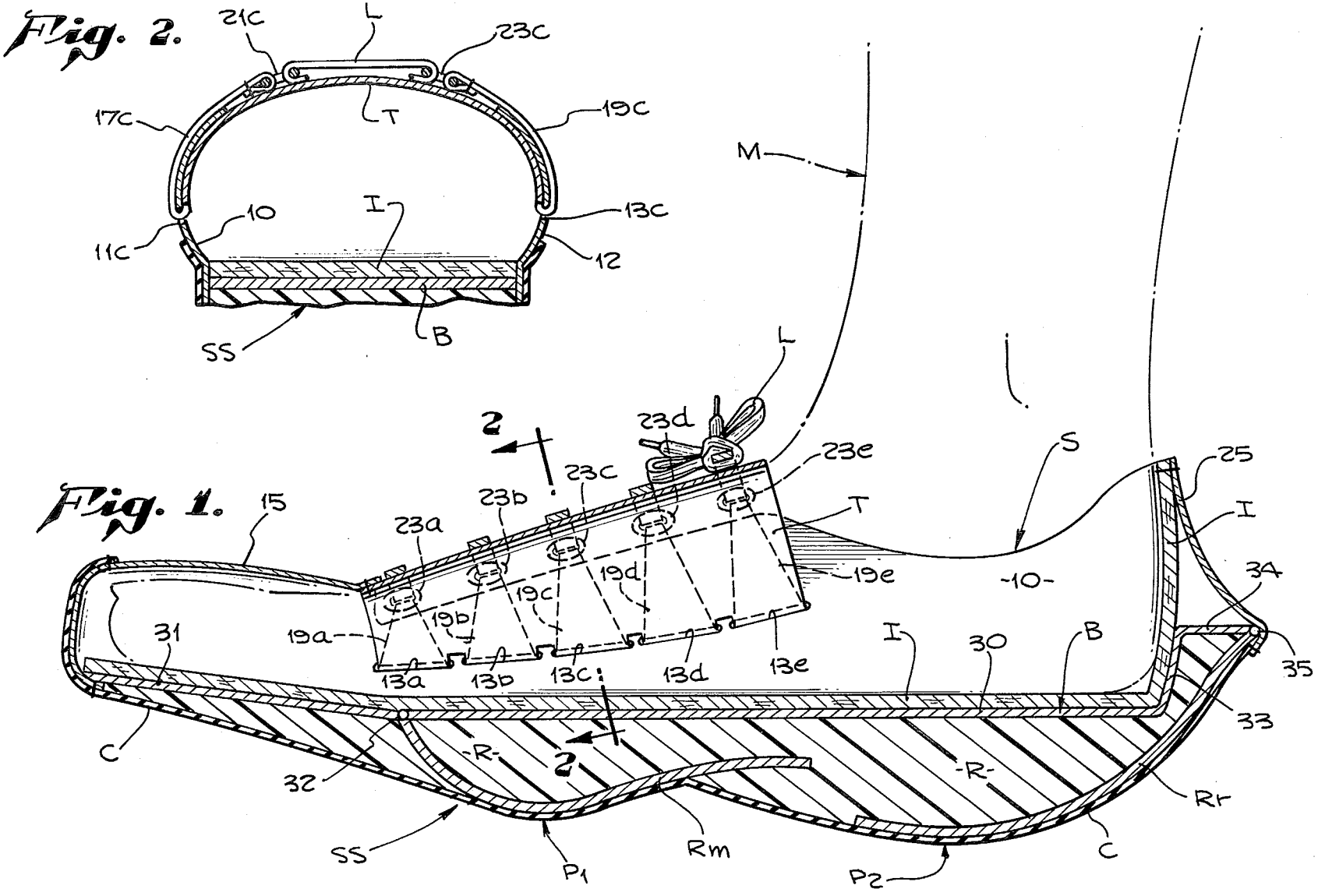
FIG. 1 is a longitudinal cross-sectional elevational view of a shoe in accordance with the present invention.
FIG. 2 is a lateral cross-sectional view of the fastening structure taken on line 2—2 of FIG. 1.

Reference is now made to FIGS. 1–5, inclusive, illustrating a first embodiment of the invention. The fastening means as shown in FIGS. 1 and 2 will first be described.

The shoe S is worn by a man M whose foot and ankle are shown in dotted lines in FIG. 1. Shoe S includes an elongated flat rigid supporting base B which runs the full length of the shoe, for supporting the foot of the wearer. The upper structure of the shoe includes an inner side wall 10 and an outer side wall 12 which are best seen in FIG. 2. A sole or supporting structure SS is associated with base B and the side walls 10, 12 extend upward from the sole structure. An insole I extends between the side walls and rests upon the base B.

At the forward end of the shoe the side walls 10, 12 merge into a toe portion 15. A tongue member T covers the ridge of the wearer's foot and occupies what would otherwise be an open space between the tops of the side walls 10, 12. Tongue member T also extends along the inner surfaces of the side walls 10, 12 in firm engagement with them. The lower end of tongue member T is sewed underneath the inner extremity of the toe portion 15 (see FIG. 1).

Each of the side walls 10, 12 has a series of longitudinally extending slits formed therein, which are located near to the base and hence near to the sole structure. The slits 13*a* . . . 13*e* which are formed in side wall 12 are clearly seen in FIG. 1, where the upper edge of each slit is represented by a dotted line. FIG. 2 shows the slit 11*c* formed in side wall 10.

Figures 5, 6:
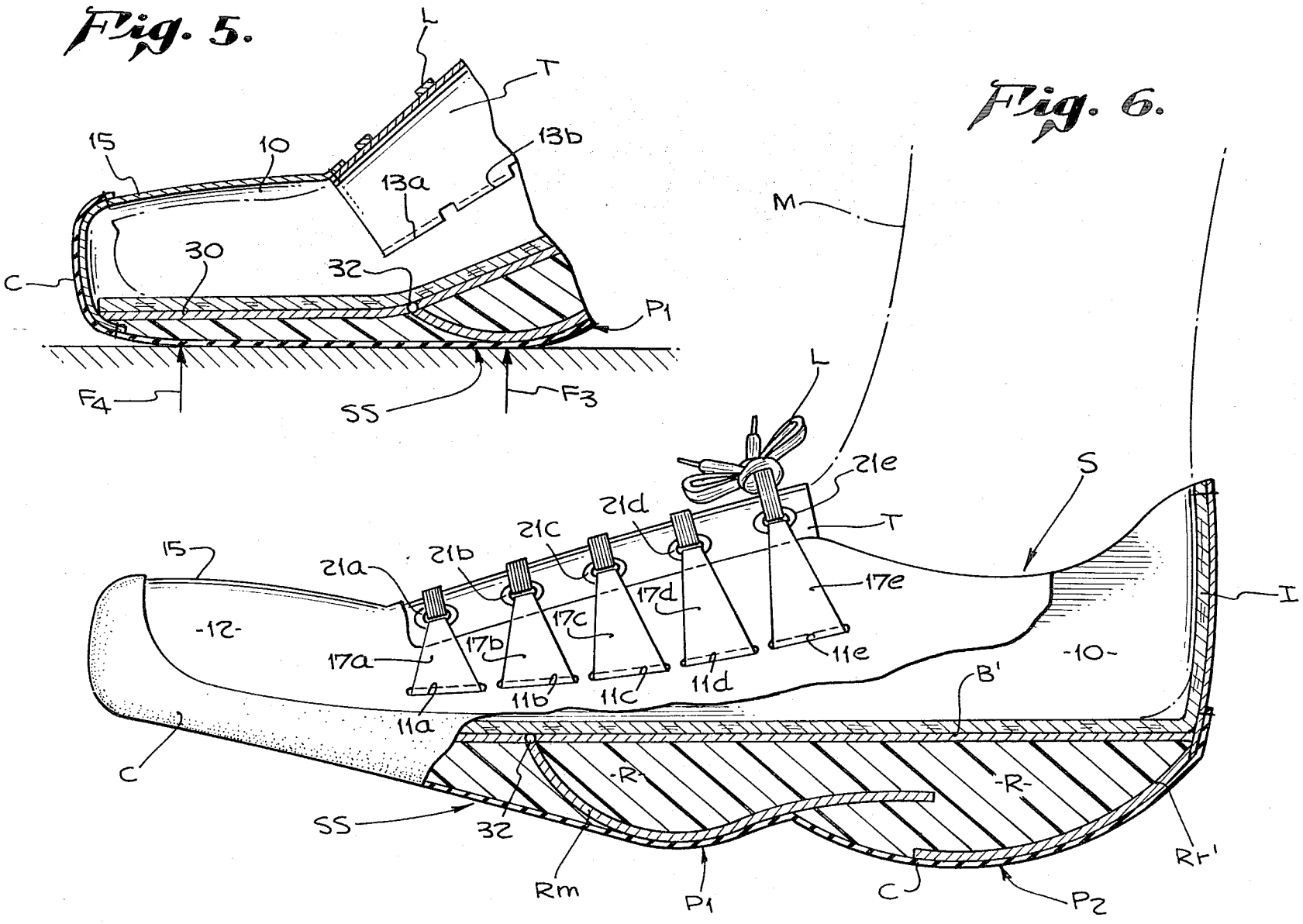
FIG. 5 is a fragmentary cross-sectional view of the shoe of FIG. 1 in a further advanced running position in which the weight load is carried on the toe of the shoe prior to take off.
FIG. 6 is a side elevation view, partly in cross-section, of an alternate form of shoe according to the invention.

Reference is also made to FIGS. 4 and 6 which show additional details of the fastening structure. The shoe of FIG. 6 is identical to the shoe of FIG. 1 insofar as the fastening structure is concerned, and differs only in respect to the sole and heel structure.

Thus in FIG. 6 the outer surface of the inner side wall 10 is seen, having the slits 11*a* . . . 11*e* formed therein. Tongue member T on its left side extends all the way down to the slits 11*a* . . . 11*e* and on its right side extends all the way down to the slits 13*a* . . . 13*e*. See FIG. 2. Immediately above the slit locations each side of the tongue member is separated into a number of lateral fingers. Thus the fingers 17*a* . . . 17*e* extend outward through the slits 11*a* . . . 11*e*, respectively, and then are bent in the reverse direction so as to extend up the outer surface of the inner side wall 10. This inner set of fingers is shown in full in FIG. 6.

FIG. 4 shows the right hand side of tongue member T to the extent that it lies inside the right hand or other side wall 12 of the shoe. Immediately above the location of the slits 13*a* . . . 13*e* the tongue member T is cut away at four different points along its length so as to form the outer set of five fingers 19*a* . . . 19*e*. These fingers, like the fingers 17, are of a generally triangular or sawtooth configuration. The fingers 19*a* . . . 19*e* pass outward through the respective slits 13*a*. . . 13*e* and are then bent upward along the outer surface of the side wall 12.

A set of eyes 21*a* . . . 21*e* are attached to the upper ends of the fingers 17*a* . . . 17*e*, respectively. See FIG. 6. In similar fashion a set of eyes 23*a* . . . 23*e* are attached to the upper ends of the fingers 19*a* . . . 19*e*. See FIGS. 1 and 2.

A shoe lace L is employed to tie the two sets of eyes 21*a*, 23*a*; . . . 21*e*, 23*e*, together. The lace L is both an adjustable and a removable type of fastening device, and it is therefore possible to tighten each one of the tongue fingers 17, 19 to a comfortable or otherwise desired position in the course of tightening up the shoe lace L before it is tied.

While the present drawings illustrate a shoe lace as the mechanism for fastening the eyes 21*a*, 23*a*; . . . 21*e*, 23*e* together, nevertheless if desired, a set of hooks may instead be used for that purpose. Alternatively, the eyes may be omitted and the tongue fingers made longer, in which case each pair of the tonque fingers 17*a*, 19*a*; . . . 17*e*, 19*e*; may be separately tied together.

THE SUPPORT STRUCTURE OF FIGS. 1-5

In the shoe of FIG. 1 a supporting or sole structure generally designated as SS includes the base B as well as a number of other structural elements positioned beneath it. This structure will now be described.

Base B is formed as a relatively flat rigid sheet-like member which is normally horizontally disposed so as to provide a supporting base for the wearer's foot. Suitable material for the base B is two-ply or three-ply Kevlar or graphite. A rearward portion 30 of base B extends from the rearward extremity of the heel of the wearer's foot to the region of the metatarsal arch. A forward portion 31 of the base extends from the rear portion forwardly to the toe of the shoe. These two portions of the base B are hingedly secured along a line 32 which extends laterally at the metatarsal arch location, the hinge being schematically indicated in FIG. 1 as a circle. It is essential that the rearward portion 30 of base B be rather rigid with limited flexing ability. The forward portion 31, however, may have somewhat more flexing capability. At the rearward end of the rear portion 30 the base B is bent upwardly in a perpendicular direction to form a short vertical wall section 33. At the top of wall section 33 the base is again bent to a horizontal configuration, forming a small shelf or shoulder 34.

Insole I may be made of any desired kind of soft material. It rests upon the base B and extends the full length of the base sections 30, 31. At its rearward end the insole I is upwardly bent and extends a considerable distance upward so as to fully enclose the heel of the wearer. A rear wall 25 is sewed or otherwise fastened to the upper extremity of insole I, extends downwardly and is outwardly curved, and then passes over the outer extremity of the shelf 34 of base B. Heel 25 is preferably made of the same material as the side walls 10, 12, and is preferably formed in a continuous or integral fashion with one or both of the side walls.

A main rocker Rm is positioned beneath the central portion of base B in a near-parallel relationship thereto. Rocker Rm is curved longitudinally into a partial S configuration. Its forward end is secured to base B at the hinge 32 in pivotal relationship to the base B. Rocker Rm then extends downwardly and is curved in a convex fashion so as to form a main pedestal P1. The rearward end of rocker Rm is then curved in the opposite direction so as to be essentially parallel to the rear portion 30 of base B, although vertically spaced some distance beneath it. The space between rocker Rm and base B is filled with resilient material R.

A rear rocker Rr is positioned beneath the rearward end of base B. Rocker Rr is convexly curved throughout its length so as to provide a second pedestal or support point 92. The rearward extremity of rocker or is attached to the rearward edge of shelf 34 of base B, in pivotal relation therewith. Hinged connection of the two members is schematically illustrated in FIG. 1 by means of a circle 35. Resilient material R also fills the space between rocker Rr and base B.

In the shoe of FIG. 1 the length of forward portion 31 of base B is about three or three and one-half inches, or nearly one-third the total length of the shoe. The horizontal length of main rocker Rm is about three and one-half inches. The forward end of rear rocker Rr and the rearward end of main rocker Rm do not overlap; there is a small longitudinal gap between them. Also, the vertical spacing of the forward end of rear rocker Rr beneath base 30 is about twice that of the rearward end of main rocker Rm. This spatial relationship allows the main rocker to pivot about its forward end and the rear rocker to pivot about its rearward end, either individually or concurrently, without mutual interference.

In order for the rockers to effectively perform their functional purposes they are constructed of material which is relatively rigid and has only a limited amount of flexibility. Again, two-ply or three-ply graphite or Kevlar may be used. In contrast, resilient material R has a great deal of resilience and is selected specifically for its ability to absorb impact forces. The material R may be neoprene rubber, for example.

The complete supporting structure SS also includes a quantity of resilient material R which is positioned beneath the forward base portion 31. The undersurface of that structure is tapered at a rather constant angle from the apex of the pedestal P1 to the forward extremity of base portion 31. Resilient material R also covers a portion of the rearward end of main pedestal Rm. However, a significant portion of main rocker Rm which forms the pedestal P1 has no resilient material R on its lower and hence outer surface. A thin rubber cover C extends underneath the entire supporting structure covering all of the otherwise exposed surfaces of both the resilient material R and the rockers Rm and Rr. At the rearward extremity of the shoe the cover C is stitched or otherwise fastened to the heel wall 25 of the shoe. At the forward extremity of the shoe cover C passes over the vertical end of the toe housing 15 and terminates on the upper surface of the toe housing and is attached thereto.

OPERATION

The operation of the shoe of FIG. 1 is illustrated in FIGS. 3, 4, and 5.

FIG. 3 shows the response of the supporting structure when the runner lands on his heel. Rear rocker Rr pivots about the hinge 35 and compresses the resilient material R that lies between it and base B. This is the result of impact force indicated by an arrow F1 in FIG. 3. It will be noted, however, that the thickness of resilient material R is such that rear rocker Rr does not actually contact base B except at the location of hinge 35.

Although not specifically shown, it will be understood that after the foot of the runner strikes the ground heel first as shown in FIG. 3, there is then a forward rolling motion of the foot and shoe, and that rolling motion is expedited by the convex curvature of the outer surface of the rear rocker Rr. FIG. 4 shows the operative position of the shoe when the rear rocker is not engaging the ground and all of the load is carried on pedestal P1. The force of that load is indicated in FIG. 4 by an arrow designated F2. If the runner initially hit the ground with his heel as shown in FIG. 3 then the force F2 is of a minimum value. However, if the runner landed on the ball of his foot in the first instance the force F2 is a maximum value. Force F2 causes resilient material R located above the main rocker Rm to compress, thereby absorbing the impact.

FIG. 5 shows the position of the toe portion of the shoe prior to take-off. Force arrows F3, F4 indicate that much vertical load is taken by the resilient material R underneath the forward portion 31 of base B. As clearly seen in FIG. 5, the forward portion 31 of base member B is bent upwardly relative to the rearward portion 30 through an angle of about 20 degrees or more. The maximum angle during take-off movements may be as much as about 45 degrees.

STRUCTURAL MATERIALS

The upper walls 10, 12, 15, 25 may be made of canvas, leather, or other sheet material that is reasonably flexible but not stretchy. The insole I may be made of any desired material that is reasonably soft and is comfortable to the foot.

Base B is preferably made from graphite fibers or from Kevlar or glass fibers, fused together by suitable means. The material used should have high tensile strength, essentially no resilience, and a limited amount of flexibility.

The base B including separate portions 30, 31, 33, and 34 may be cast or molded as a single integral member. One or both of the rocker members Rm and Rr may also be integrally cast or molded with the base member.

Proportions shown in the drawings for the pivot connections 32, 35, are not restrictive. For example, if the base member and the two rocker members are cast as an integral piece the thickness of the material at these pivot joints may be increased considerably, in order to provide adequate strength.

The resilient material R may be any highly resilient material, such as neoprene rubber. In a particular shoe design it may be desired to pack the space above one of the rockers with material of a different hardness than is used in filling the space above the other. In general, however, it is believed acceptable to use resilient material having the same degree of resilience and other physical characteristics throughout the entire supporting structure SS. The cover C is selected largely for its wear resistance capability, and should therefore have different characteristics than the resilient material R.

ALTERNATE HINGE CONSTRUCTION

FIG. 7 illustrates an alternate hinge construction for attaching the base portions 30, 31 and the rocker Rm. Base portion 30 and rocker member Rm are cast or molded as a single member. Forward base portion 31 is formed separately. The two members are pinned together with a metal pin at 32. Forward base portion 31 has a pair of rearwardly extending side arms 31*a* whose ends carry another pin 31*b*. The pin 31*b* passes underneath the base portion 30, and thereby locks the base forward extension 31 against dropping down to the same level as base portion 30. In other words, the forward extension of the base is always elevated by at least some measurable angle relative to the rear base portion 30.

THE ELEVATED TOE

In the shoe of FIGS. 1–5 the toe portion of the shoe always remains elevated by an angle of at five degrees relative to the remainder of the shoe. While this particular feature is not believed to be indispensable it nevertheless is a part of the preferred design at this time.

In order to achieve this elevation it is, of course, necessary that forward base portion 31 be bent upwards relative to the rear base portion 30. The shoe housing including side walls 10 and 12 and the toe wall 15, may be constructed in such a manner as to maintain this minimum elevation at all times. Alternatively, a hinge structure such as shown in FIG. 7 may be incorporated into the shoe in order to achieve the same results.

Preferably the shoe is so constructed that when empty its toe portion is elevated at an angle of about 15 degrees. When the runner places his foot within the shoe his toes will then depress the toe portion of the shoe to some extent. That movement gives the runner's toes a firm engagement with and a firm grip upon the toe portion of the shoe. This gives the runner the ability to more effectively manipulate the shoe through manipulating his toes.

More specifically, one definite advantage of this construction of the shoe is that is counteracts any tendency for the shoe to come loose at the heel and fly off of the runner's foot.

Another advantage is that the runner's ability to achieve a forward rolling movement when supported at pedestal P1 by the main rocker Rm is greatly improved.

A further advantage of this construction is that, immediately prior to take-off, the runner's toes are in much better command of the position and the movements of the shoe. A more carefully and precise take-off can therefore be achieved.

SECOND EMBODIMENT

(FIG. 6)

Based on the embodiment of FIG. 6 the toe portion of the shoe is not elevated, but it may be made permanently elevated if that is desired.

The fastening means shown in FIG. 6, as previously explained, is the same as shown in FIG. 1. However, a different and more conventional type of fastening means may be incorporated in the shoe of FIG. 6 if that is desired.

The construction of the central and forward portion of base B and of main rocker Rm is the same as in the first embodiment. The rise 33 and shelf 34 in base B are eliminated, hence in FIG. 6 the base is identified as B'. Rear rocker Rr' is pivotally secured to the base B' immediately beneath and behind the lower corner of the heel of the wearer's foot. Since the base of the shoe is significantly shortened the forward end of rocker Rr' does to some extent overlap the rearward end of main rocker Rm. However, the vertical separation between the two rockers is still maintained.

OPERATION

The shoe of FIG. 6 is not as advantageous for use by a runner who either regularly or occasionally lands on his heel. If the runner, by training or otherwise, consistently lands on the ball of his foot, then the shoe of FIG. 6 may be more advantageous than the shoe of FIG. 1.

The shoe of FIG. 6 is also advantageous for use as a walking shoe. The vertical load is initially carried upon the rear pedestal P2. After a certain rolling movement has been accomplished a portion of the vertical load is transferred to the front pedestal P1. Then the vertical load is all transferred to the front pedestal, and normally this is accomplished within a small portion of a second, but the time interval involved is definitely measurable because the resilience of resilient material R requires a finite amount of time both for the rear pedestal to give up its load and for the front pedestal to assume the load.

After all of the vertical load is transferred to the front pedestal a further rolling action takes place, and then the toe portion of the shoe bends upward preparatory to take-off. The mechanism or movement pattern for take off during walking is basically the same as that during running movements. However, the walking movement is slower, there is more time available for the toes of the foot to perform their necessary guidance function, and hence the necessity or advisability of having the toe portion of the shoe pre-elevated is greatly diminished or altogether absent.

PEDESTAL DIMENSIONS

The vertical height of each pedestal measured beneath the base B, when not carrying a vertical load, is in the general range of about three-quarter inch to one and one-half inches. For example, the height of the center or main pedestal might be seven-eighths inch while the height of the rear pedestal is 1.0 inch.

During running movements the center of gravity of the body of a runner moves up and down a relatively short distance, such as about two inches to about four inches. It is necessary for resilient material R to compress in order to absorb each vertical impact, but the magnitude of each compression will ordinarily be only about one-quarter inch, more or less. A pedestal height of three-quarter inch therefore makes fully ample provision for the maximum compression than can be expected to occur. A pedestal height as low as one-half inch may be found advantageous.

There is a relationship between pedestal height and turning radius. The turning radius for each pedestal should be such as to fit the natural movement characteristics of the particular runner's body. A very high pedestal, such as five inches, would either have much too short a turning radius, or else it would occupy much more of the length of the shoe than is practical.

In general, therefore, the turning radius of the main pedestal will be selected to conform to the stride or speed of the runner. A fast runner will need a pedestal with a longer turning radius. A relatively short turning radius is preferred for a walking shoe.

The turning radius for the rear pedestal will in general be larger than the turning radius for the main or front pedestal. The considerations which enter into the selection of turning radius for the two pedestals are not identical, however.

OTHER ADVANTAGES

An advantage of the rear pedestal or rear rocker configuration as shown in FIG. 1 is that the runner's foot is well protected. No matter at what angle he lands on his heel, the rear rocker spreads the load through a substantial quantity of the resilient material R, avoiding any sharp impact on the runner's foot. This is particularly important, for example, when stepping on a sharp rock.

The invention has been described in considerable detail in order to comply with the patent laws by providing a full public disclosure of at least one of its forms. However, such details description is not intended in any way to limit the broad features or principles of the invention, or the scope of patent monopoly to be granted.

What is claimed is:

1. In the supporting structure of a shoe, the combination comprising:

a relatively flat rigid sheet-like member normally horizontally disposed to provide a supporting base for the wearer's foot;

a relatively rigid rocker member of a generally sheet-like configuration disposed beneath said base in a rear-parallel relationship thereto, one end of said rocker member being pivotally secured to said base and the other end being spaced below said base;

said rocker member being longitudinally curved in a downwardly convex direction to form a load-bearing pedestal; and a body of resilient material occupying the space between said rocker member and said base.

* * * * *